US007735294B2

(12) United States Patent
Moody et al.

(10) Patent No.: US 7,735,294 B2
(45) Date of Patent: Jun. 15, 2010

(54) ROOF TRUSS

(75) Inventors: Donald R. Moody, Denton, TX (US); Courtney J. Hanson, Denton, TX (US); Thomas Corbet Ellis, Napier (NZ)

(73) Assignee: Nucon Steel Corporation, Denton, TX (US)

( * ) Notice: Subject to any disclaimer, the term of this patent is extended or adjusted under 35 U.S.C. 154(b) by 0 days.

(21) Appl. No.: 12/190,362

(22) Filed: Aug. 12, 2008

(65) Prior Publication Data

US 2008/0295448 A1 Dec. 4, 2008

Related U.S. Application Data

(62) Division of application No. 10/905,011, filed on Dec. 9, 2004, now Pat. No. 7,409,804.

(60) Provisional application No. 60/528,128, filed on Dec. 9, 2003.

(51) Int. Cl.
*E04C 3/11* (2006.01)

(52) U.S. Cl. ..... 52/745.19; 52/639; 52/90.1; 29/897.31

(58) Field of Classification Search ..... 52/90.1, 52/634–636, 639, 693–696, 690; 403/256, 403/263; 29/281.3, 897.3, 897.31, 897.312
See application file for complete search history.

(56) References Cited

U.S. PATENT DOCUMENTS 1,311,486 A 7/1919 Benedict
1,747,313 A 2/1930 Miss
1,900,541 A 3/1933 Beulow et al.
1,924,880 A 8/1933 Ragsdale
1,925,769 A 9/1933 McAvoy et al.

(Continued)

FOREIGN PATENT DOCUMENTS

CA 476296 8/1951

(Continued)

OTHER PUBLICATIONS

Nucon Steel Corporation, International Patent Application No. PCT/US04/41507; International Search and Written Opinion; dated Jul. 19, 2006.

(Continued)

*Primary Examiner*—Robert J Canfield
*Assistant Examiner*—Christine T Cajilig
(74) *Attorney, Agent, or Firm*—Moore & Van Allen PLLC; Jeffrey R. Gray

(57) ABSTRACT

A metal roof truss assembly is provided comprising a plurality of elongated structural members, including a top chord, a bottom chord, and a web member. Each structural member comprises a planar base and planar legs extending from the longitudinal edges of the base. The base and the legs define an open longitudinal channel. A flange integral with the longitudinal edges of each leg has a planar first portion extending outwardly from the legs and a planar second portion extending from the longitudinal edges of the first portion of the flanges. The end of a first structural member is inserted into the channel defined by the legs and the base of a second structural member. The inserted end of the first structural member has no flanges for a length equal to at least the depth to which the first structural member is received in the channel of the second structural member so that the outer surface of the legs of the first structural member are adjacent the inner surface of the legs of the second structural member.

5 Claims, 18 Drawing Sheets

U.S. PATENT DOCUMENTS

| | | | | | |
|---|---|---|---|---|---|
| 1,963,184 | A | | 6/1934 | Webster | |
| 2,067,403 | A | | 1/1937 | Lea | |
| 2,210,026 | A | | 8/1940 | Connors, Jr. | |
| 2,234,960 | A | | 3/1941 | Buelow | |
| 2,284,898 | A | * | 6/1942 | Hartman | 52/654.1 |
| 2,329,041 | A | | 9/1943 | Ford | |
| 2,541,784 | A | | 2/1951 | Shannon | |
| 2,624,430 | A | | 1/1953 | Macomber | |
| 2,630,890 | A | | 3/1953 | Macomber | |
| 2,642,825 | A | | 6/1953 | McElhone et al. | |
| 2,687,102 | A | | 8/1954 | Rongved et al. | |
| 2,982,055 | A | * | 5/1961 | Thompson | 52/643 |
| 3,029,914 | A | | 4/1962 | Macomber | |
| 3,541,749 | A | | 11/1970 | Troutner | |
| 3,585,121 | A | | 6/1971 | Tate et al. | |
| 3,651,612 | A | | 3/1972 | Schmitt | |
| 3,656,270 | A | | 4/1972 | Phillips | |
| 3,668,828 | A | | 6/1972 | Nicholas et al. | |
| 3,686,819 | A | | 8/1972 | Atkinson | |
| 3,882,653 | A | | 5/1975 | Oilman | |
| 4,074,487 | A | | 2/1978 | Daniels et al. | |
| 4,141,191 | A | | 2/1979 | Aarons | |
| 4,159,604 | A | | 7/1979 | Burrell | |
| 4,295,312 | A | | 10/1981 | Campbell | |
| 4,389,829 | A | | 6/1983 | Murphy | |
| 4,435,940 | A | * | 3/1984 | Davenport et al. | 52/641 |
| 4,483,118 | A | | 11/1984 | Betschart | |
| 4,530,191 | A | | 7/1985 | Boisbluche | |
| 4,551,957 | A | | 11/1985 | Madray | |
| 4,615,157 | A | | 10/1986 | Murray | |
| 4,616,453 | A | | 10/1986 | Sheppard, Jr. et al. | |
| 4,669,243 | A | | 6/1987 | Gore et al. | |
| 4,720,956 | A | | 1/1988 | Wiklund | |
| 4,827,688 | A | | 5/1989 | Tene | |
| 4,858,398 | A | | 8/1989 | Ricchini | |
| 4,863,189 | A | | 9/1989 | Lindsay | |
| 4,907,390 | A | | 3/1990 | Tene | |
| 4,943,038 | A | | 7/1990 | Harnden | |
| 4,982,545 | A | | 1/1991 | Stromback | |
| 5,457,927 | A | | 10/1995 | Pellock et al. | |
| 5,463,837 | A | * | 11/1995 | Dry | 52/639 |
| 5,526,628 | A | | 6/1996 | Knudson | |
| 5,553,375 | A | | 9/1996 | Powers | |
| 5,577,353 | A | | 11/1996 | Simpson | |
| 5,649,403 | A | | 7/1997 | Haisch | |
| 5,651,230 | A | | 7/1997 | Knudson | |
| 5,722,210 | A | * | 3/1998 | Baker et al. | 52/643 |
| 5,743,691 | A | * | 4/1998 | Donovan | 411/180 |
| 5,771,653 | A | | 6/1998 | Dolati et al. | |
| 5,857,306 | A | | 1/1999 | Pellock | |
| 5,865,008 | A | | 2/1999 | Larson | |
| 5,873,567 | A | | 2/1999 | Williams | |
| 5,884,448 | A | * | 3/1999 | Pellock | 52/643 |
| 5,983,589 | A | | 11/1999 | Daudet | |
| 6,073,414 | A | | 6/2000 | Garris et al. | |
| 6,079,174 | A | | 6/2000 | Williams et al. | |
| 6,088,988 | A | | 7/2000 | Sahramaa | |
| 6,237,297 | B1 | | 5/2001 | Paroly | |
| 6,253,521 | B1 | * | 7/2001 | Gavin et al. | 52/639 |
| 6,272,447 | B1 | * | 8/2001 | Gavin et al. | 703/1 |
| 6,354,056 | B1 | | 3/2002 | Korzen | |
| 6,415,511 | B1 | | 7/2002 | Kennelly et al. | |
| 6,553,736 | B2 | * | 4/2003 | Montanaro et al. | 52/633 |
| 6,560,858 | B1 | | 5/2003 | McAdoo | |
| 6,658,809 | B2 | * | 12/2003 | Collins | 52/639 |
| 6,757,643 | B2 | | 6/2004 | Gavin et al. | |
| 7,093,401 | B2 | * | 8/2006 | Collins | 52/846 |
| 7,178,304 | B2 | * | 2/2007 | Brady | 52/653.1 |
| 2001/0044707 | A1 | | 11/2001 | Gavin et al. | |
| 2002/0005022 | A1 | | 1/2002 | Matthews | |
| 2002/0059774 | A1 | | 5/2002 | Collins | |
| 2002/0073889 | A1 | | 6/2002 | Khattab et al. | |
| 2002/0078655 | A1 | | 6/2002 | Montanaro et al. | |

FOREIGN PATENT DOCUMENTS

| | | |
|---|---|---|
| GB | 1257031 | 12/1971 |
| GB | 2094372 | 9/1982 |
| WO | PCT/AU88/00188 | 12/1988 |
| WO | PCT/AU96/00251 | 11/1996 |

OTHER PUBLICATIONS

Nucon Steel Corporation, International Patent Application No. PCT/US04/41507; International Preliminary Report on Patentability; dated Nov. 29, 2006.

Nucon Steel Corporation, Mexican Patent Application No. PA/a/2006/006461; Translation of Office Action; dated Dec. 19, 2008.

* cited by examiner

ROOF TRUSS

This application is a divisional application of U.S. patent application Ser. No. 10/905,011, filed Dec. 9, 2004, now U.S. Pat. No. 7,409,804, which is a non-provisional application of U.S. Provisional Patent Application No. 60/528,128, filed Dec. 9, 2003, the contents of both of which are incorporated herein by reference in their entirety.

BACKGROUND

A roof truss generally comprises two or more top chord members and one or more bottom chord members. The ends of the top chords are secured together, and the ends of the bottom chord(s) are connected to the lower, free ends of the top chords for forming the perimeter of the roof truss. One or more web members span between and interconnect the top and bottom chords. The web members are secured at their ends to the top chord(s) and to the bottom chord(s).

In building construction, the roof structure is formed from a plurality of trusses set out across a building frame on anywhere from about 12 to about 60 inch centers. When erected upon the building frame, the truss spans the wall frames of the building and is fixed to the top of wall support frames. The sub-roof material is then fastened to the top chords, and ceiling material may be fastened to the bottom chords. The reactions resulting from the combined roof live, dead, and wind loads, plus the dead loads of the roof trusses and the roof and ceiling assemblies, are transferred by the trusses to the top of wall support frames.

Historically, roof trusses have generally been constructed of wooden chords and web members. More recently, various types of metal trusses have become available. While the unit raw materials costs for metal trusses may be competitive with other building materials, metal trusses typically have not been competitive against wooden trusses. But using metal as the material of construction has a number of advantages, including relatively stable price, increased unit strength, design flexibility, durability, light weight, reliability, minimum waste in use, recyclability and noncombustability.

For the foregoing reasons, there is a need to provide a cost competitive light weight metal roof truss for use in applications for which wood trusses would be structurally sufficient. The new metal truss should be easy to assemble while providing the aforementioned benefits compared with trusses made from other building materials. The new metal roof truss should also require low capital investment to produce, be able to be adapted to mass production, and be able to be manufactured in a manufacturing facility or on a jobsite.

SUMMARY

According to the present invention, a metal roof truss assembly is provided comprising a plurality of elongated structural members, including a top chord, a bottom chord, and a web member. Each structural member comprises a planar base terminating in longitudinal edges and planar legs extending from the longitudinal edges of the base and terminating in longitudinal edges. The legs extend the length of the base such that the base and the legs define an open longitudinal channel. A flange is integral with the longitudinal edges of each leg. Each flange has a planar first portion extending outwardly from the legs and terminating in longitudinal edges, and a planar second portion extending from the longitudinal edges of the first portion of the flanges and terminating in longitudinal edges. The flanges selectively extend the length of the legs. The structural members are joined. The end of a first structural member at each junction is inserted into the channel defined by the legs and the base of a second structural member. The inserted end of the first structural member has no flanges for a length equal to at least the depth to which the first structural member is received in the channel of the second structural member so that the outer surface of the legs of the first structural member are adjacent the inner surface of the legs of the second structural member.

Also according to the present invention, a method of forming a roof truss assembly is provided. The method comprises the steps of providing a coil of substantially flat sheet metal, cutting a plurality of lengths of the sheet metal, and forming structural members from each of the lengths of metal. The structural members include a top chord, a bottom chord, and a web member. Each structural member comprises a planar base terminating in longitudinal edges and planar legs extending from the longitudinal edges of the base and terminating in longitudinal edges. The legs extend the length of the base such that the base and the legs define an open longitudinal channel. A flange integral with the longitudinal edges of each leg has a planar first portion extending outwardly from the legs and terminating in longitudinal edges, and a planar second portion extending from the longitudinal edges of the first portion of the flanges and terminating in longitudinal edges. The flanges selectively extend the length of the legs. The method' further comprises the steps of removing a portion of the flanges from an end of one of a first structural and inserting the end of the first structural member into the channel defined by the legs and the base of a second structural member so that the outer surface of the legs of the first structural member are adjacent the inner surface of the legs of the second structural member.

BRIEF DESCRIPTION OF THE DRAWINGS

For a more complete understanding of the present invention, reference should now be made to the embodiments shown in the accompanying figures and described below. In the figures.

DESCRIPTION

Certain terminology is used herein for convenience only and is not to be taken as a limitation on the present invention. For example, words such as "upper," "lower," "left," "right," "horizontal," "vertical," "upward," and "downward" merely describe the configuration shown in the Figures. Indeed, the components may be oriented in any direction and the terminology, therefore, should be understood as encompassing such variations unless specified otherwise.

Figure 1:
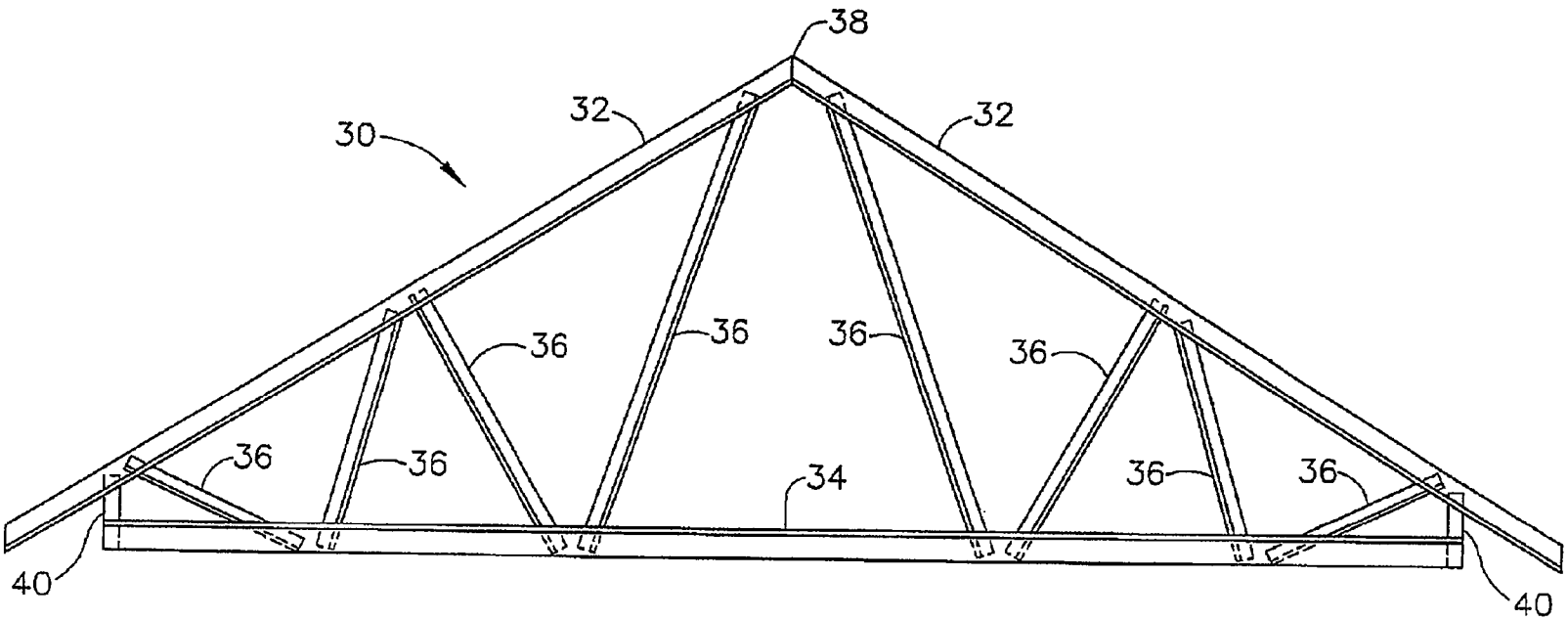
FIG. 1 is a front elevational view of a gable roof truss assembly according to the present invention.

Referring now to the drawings, wherein like reference numerals designate corresponding or similar elements throughout the several views, FIG. 1 shows an embodiment of a roof truss assembly according to the present invention, generally designated at 30. The roof truss assembly 30 comprises several structural truss members, including a pair of top, or upper, chord members 32, a bottom, or lower, chord member 34 and web members 36. Adjacent upper ends of the top chord members 32 are secured together to form an apex joint 38. In this embodiment of the truss assembly 30, a vertically-positioned heel element 40 is fastened between each end of the bottom chord member 34 and the free ends of the top chord members 32.

The top chord members 32 and the bottom chord member 34 form a triangle, with the bottom chord member 34 as the base and the top chord members 32 forming the sides of the triangle. It is well known in the art that there are a number of roof truss profiles in addition to the triangular truss assembly 30 depicted in the FIGs. We do not intend to limit the application of the present invention to a single truss profile. Rather, the present invention is applicable to all known truss profiles.

Figure 2:
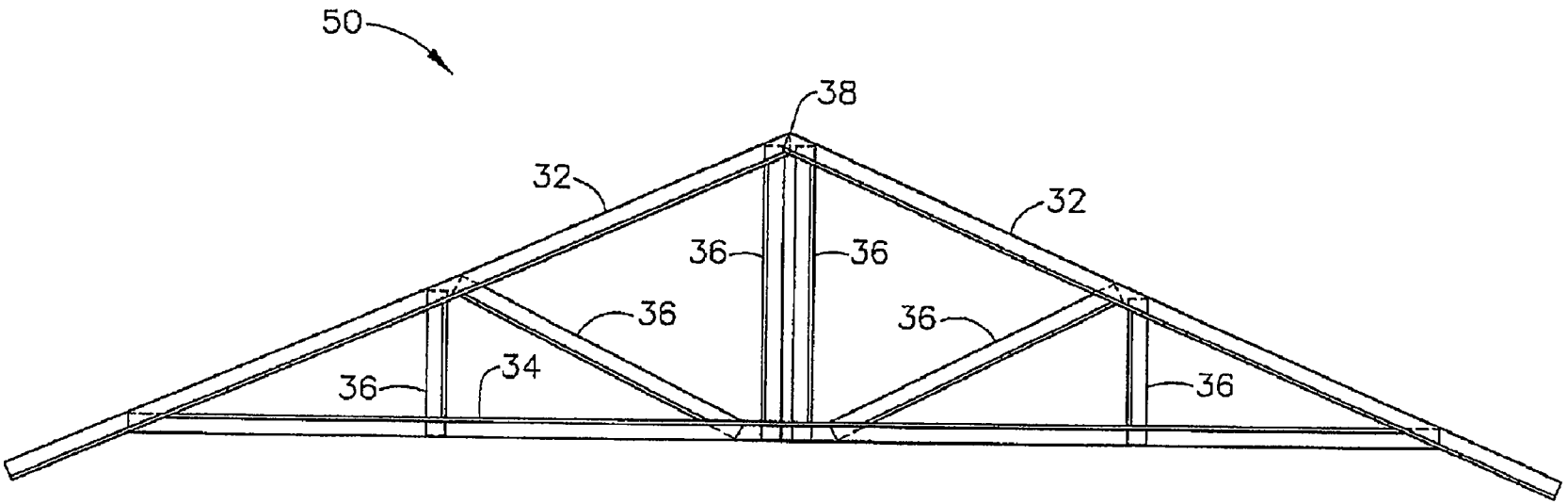
FIG. 2 is a front elevational view of a second embodiment of a roof truss assembly according to the present invention.
Figure 3:
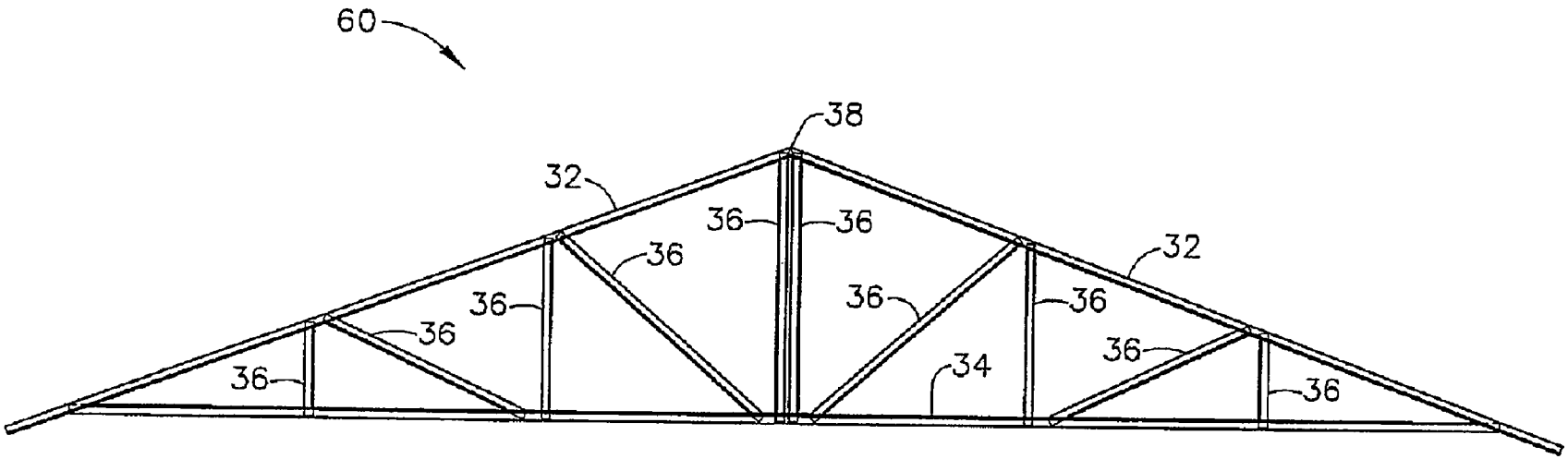
FIG. 3 is a front elevational view of a third embodiment of a roof truss assembly according to the present invention.
Figure 4:
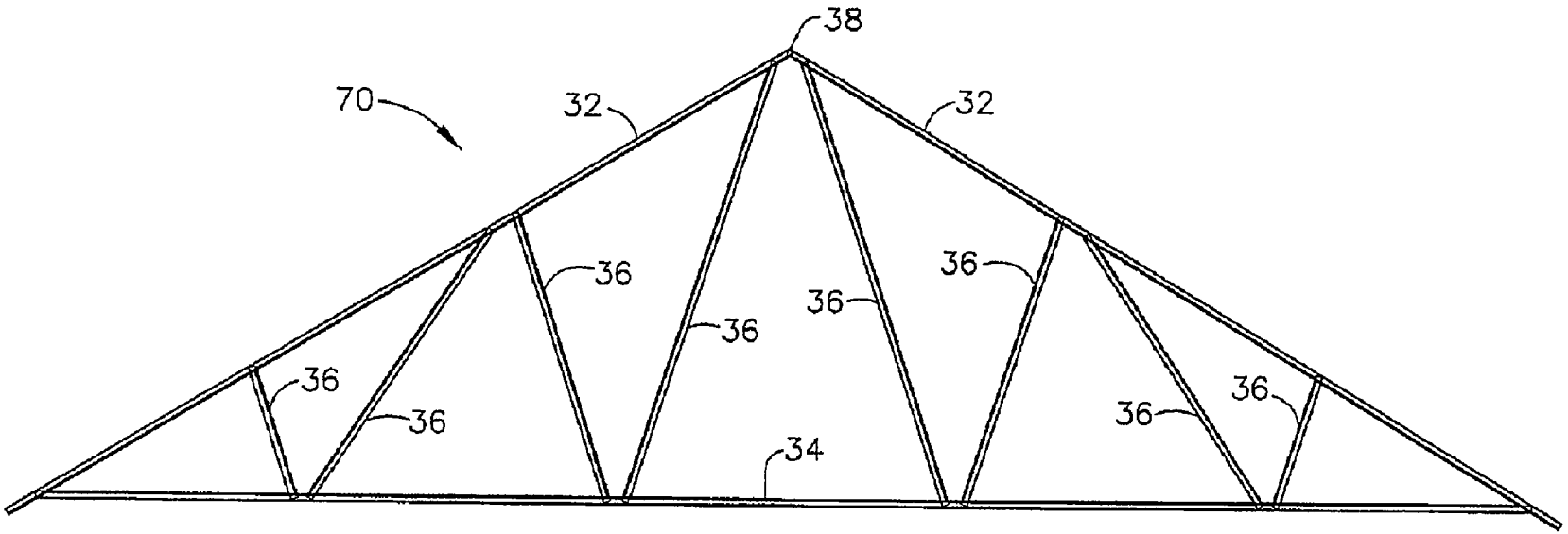
FIG. 4 is a front elevational view of a fourth embodiment of a roof truss assembly according to the present invention.

The web members 36 extend between the top chord members 32 and the bottom chord member 34. The opposite ends of the web members 36 are secured to the top chord members 32 and the bottom chord member 34 for rigidifying the roof truss assembly 30. It is understood that we do not intend to limit the application of the present invention to a roof truss assembly 30 having a predetermined position and number of web members 36 as shown in the FIGs. The number and the position of the web members 36 and the length of the top chord members 32 and bottom chord member 34 will vary as necessary depending upon the size of a building and the lengths of the chord members 32, 34, in order to provide the required structural strength. For example, a second embodiment of a truss assembly according to the present invention is shown in FIG. 2 and generally designated at 50. This truss assembly 50 does not include as many web members 36 as the truss assembly 30 shown in FIG. 1. A third embodiment of a truss assembly according to the present invention is shown in FIG. 3 and generally designated at 60. This truss assembly 60 includes more web members 36 than the truss assembly 30 shown in FIG. 1. A fourth embodiment of a truss assembly according to the present invention is shown in FIG. 4 and generally designated at 70. In the embodiments of the truss assembly 50, 60, 70 shown in FIG*s*. 2-4, the ends of the bottom chord member 34 are secured to the top chord members 32 adjacent the lower ends of the top chord members 32. Where a truss assembly will span a large distance, it may also be necessary to have a bottom chord member 34 comprising a plurality of sections which have been spliced.

Each of the structural truss members of the truss assemblies according to the present invention is formed from a strip or sheet of metal. The preferred material of construction is steel. However, the present invention is not limited to steel, and other metals such as aluminum, copper, magnesium, or other suitable metal may be appropriate. Further, it is desirable that the metal be light gauge metal, which is generally less than about 2.7 mm in thickness, for example, from about 12 to about 24 gauge. It is understood, however, that the scope of the invention is not intended to be limited by the materials listed here, but may be carried out using any material which allows the construction and use of the metal roof truss assembly described herein.

Figure 5:
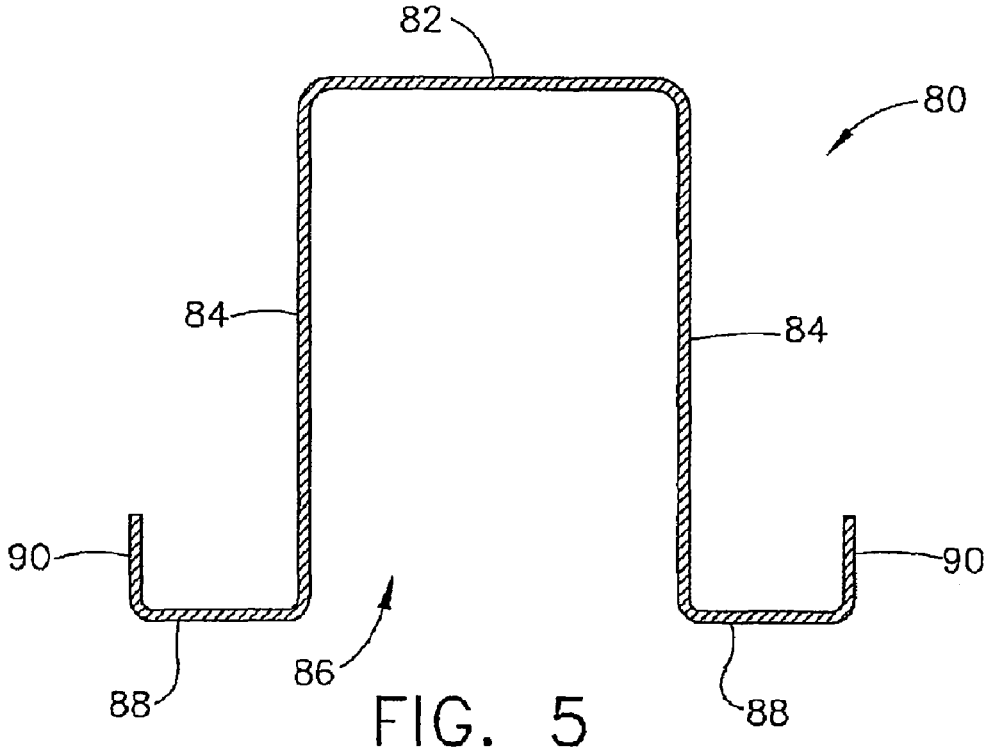
FIG. 5 is a profile section of a truss member for use in the truss assembly according to the present invention.

According to the present invention, all of the structural truss members, the top chord 32 and bottom chord 34 and the web members 36, have the same cross-sectional shape, which simplifies the supply and handling of the material forming the truss members 32, 34, 36. FIG. 5 illustrates one embodiment of a structural truss member, generally designated at 80, which is used to make up all of the truss members 32, 34, 36 of the roof truss assemblies according to the present invention. The truss member 80 is an elongated member having a substantially C-shaped or U-shaped cross-section and comprises a substantially flat flange portion 82 along a longitudinal axis and spanning between parallel, substantially flat side webs 84 which extend substantially perpendicularly from the edges of the flange portion 82. The flange portion 82 and the side webs 84 define an open longitudinal channel 86. The side webs 84 are bent outwardly at their distal ends forming substantially flat stiffening flanges 88 which are substantially normal to the plane of the side webs 84. The terminal edges of the stiffening flanges 88 are bent upwardly forming upturned lips 90 which are disposed substantially parallel with respect to the side webs 84. A steel roof truss including a top chord having the cross-section shown in FIG. 5 is described in U.S. Pat. No. 4,982,545, which issued Jan. 8, 1991 and is entitled "Economical Steel Roof Truss", the contents of which are hereby incorporated herein by reference in their entirety.

Figure 6:
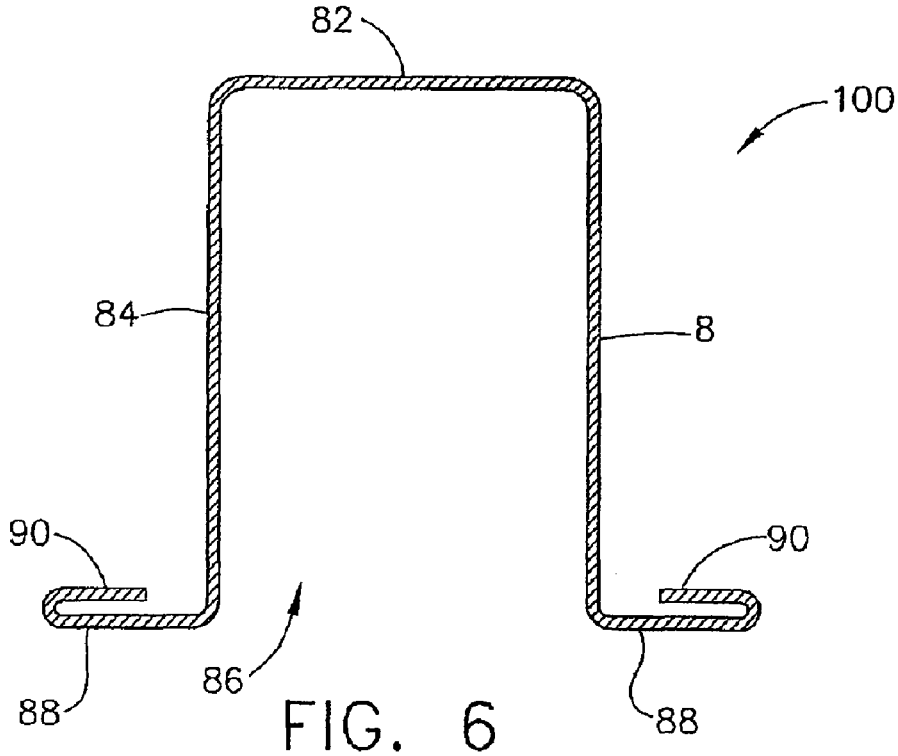
FIG. 6 is a profile section of another embodiment of a truss member for use in the truss assembly according to the present invention.

FIG. 6 shows another embodiment of a structural truss member, generally designated at 100, which may be used for all of the structural truss members 32, 34, 36 according to the present invention. In this embodiment, the terminal edges of the stiffening flanges 88 are bent over the stiffening flanges so that the lips 90 extend inwardly and substantially parallel to the stiffening flanges 88.

The dimensions of each portion of the structural truss members 80, 100 shown in FIGS. 5 and 6 may differ depending upon the length of the truss member as well as the load forces which the truss member will incur. In the embodiment of the truss member 80 shown in FIG. 5, the width of the flange portion 82 between the side webs 84 may be from about 1.5 inches to about 1.75 inches and the side webs 84 may be at least about 2 inches long. Each of the stiffening flanges 88 may be from about 0.5 inches to about 0.6 inches wide and the lips 90 may be from about 0.25 to about 0.4 inches wide. In the second embodiment of the truss member 100 shown in FIG. 6, the parallelly disposed lips 90 may extend about 0.25 inches along the stiffening flanges 88. In keeping with the present invention, an important consideration is the length, or height, of the side webs 84, which translates to the depth of the truss member 80, 100. The truss member 80, 100 may be manufactured in varying depths and widths depending on the required strength to weight ratio necessary to meet load bearing requirements and the gauge of metal used to form the truss member 80, 100.

Figure 7:
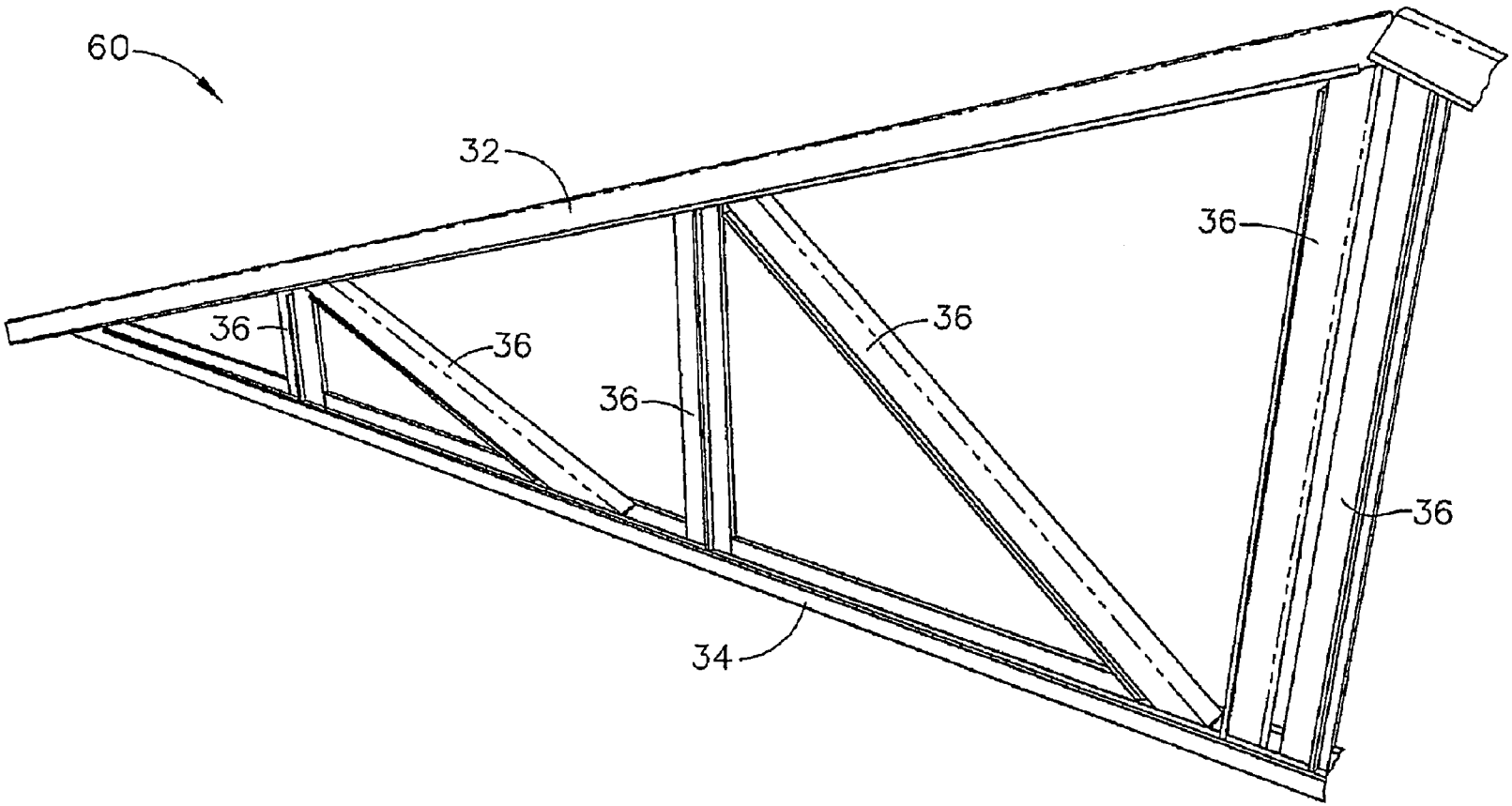
FIG. 7 is a perspective view of one half of the embodiment of the truss assembly shown in FIG. 3.

Referring now to FIG. 7, which is a perspective view of one half of the roof truss assembly 60 shown in FIG. 3, when the truss assembly 60 is assembled, the open longitudinal channel 86 of the bottom chord member 34 faces upwardly and the open longitudinal channels 86 of the top chord members 32, which are not visible in FIG. 7, face downwardly. Structural joints are created where the top chord member 32 and the bottom chord member 34 and the web members 36 intersect one another. The joints between the truss members can be secured using fasteners 42, such as bolts and nuts, metal screws, rivets, or any combination thereof. Alternatively, the truss members may be joined by welding, soldering, and the like.

Figure 8:
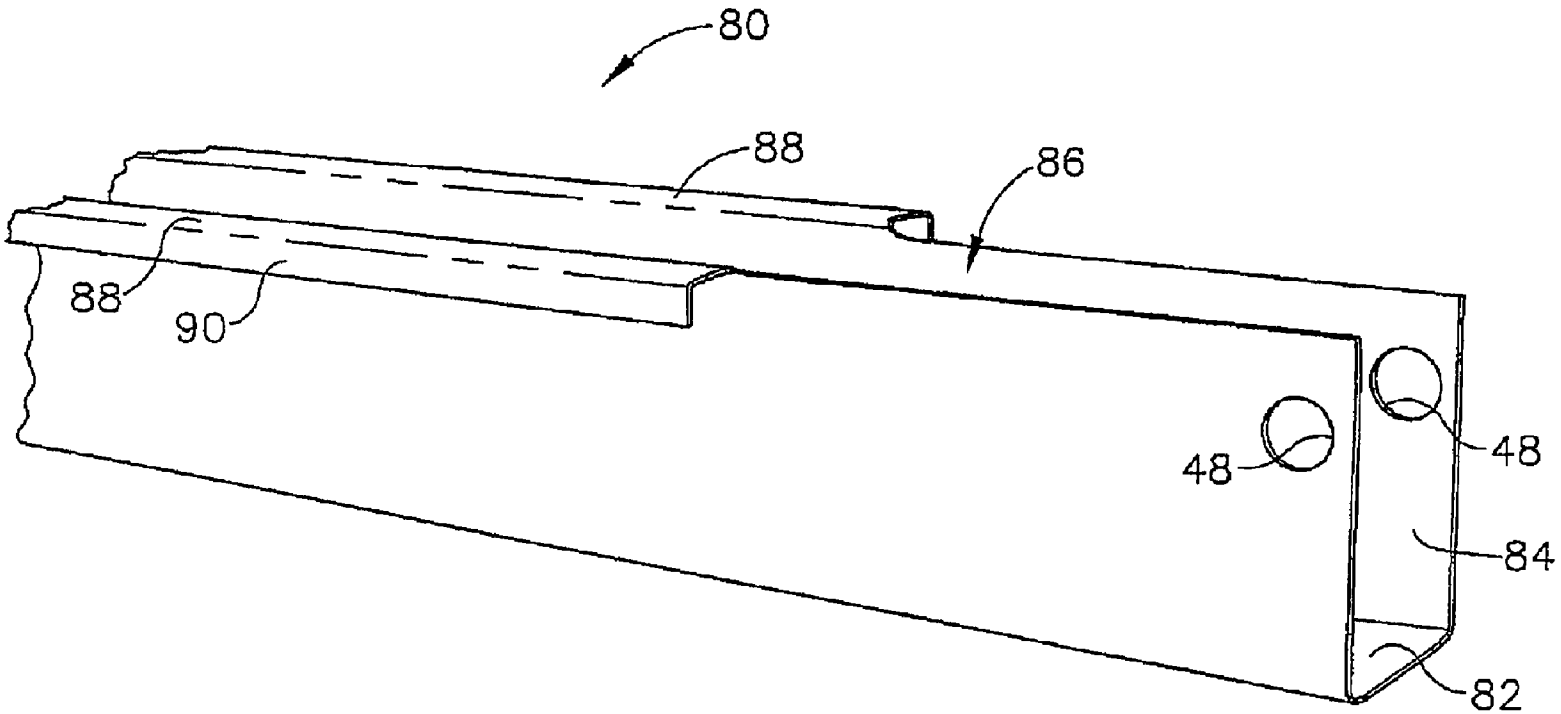
FIG. 8 is a perspective view of a notched truss member for use in a truss assembly according to the present invention.

In joining the structural truss members 32, 34, 36 according to the present invention, a portion of one end of a truss member is inserted into the open channel 86 of another truss member. The inserted end of the truss member is re-shaped, such as by bending, notching, and the like, to allow insertion into the open channel 86 of the other truss member. The inserted ends of the truss member may also be butt cut to simplify assembly as well as to minimize fabrication time and the chance for error, which may exist when precise geometric cuts are used. Referring to FIG. 8, an end of a re-shaped truss member 80 is shown with a length of the stiffening flanges 88 and upturned lips 90 of the truss member 80 cut away from the side webs 84 in an area where the truss member 80 is to be inserted into and joined with another truss member.

Figure 9:
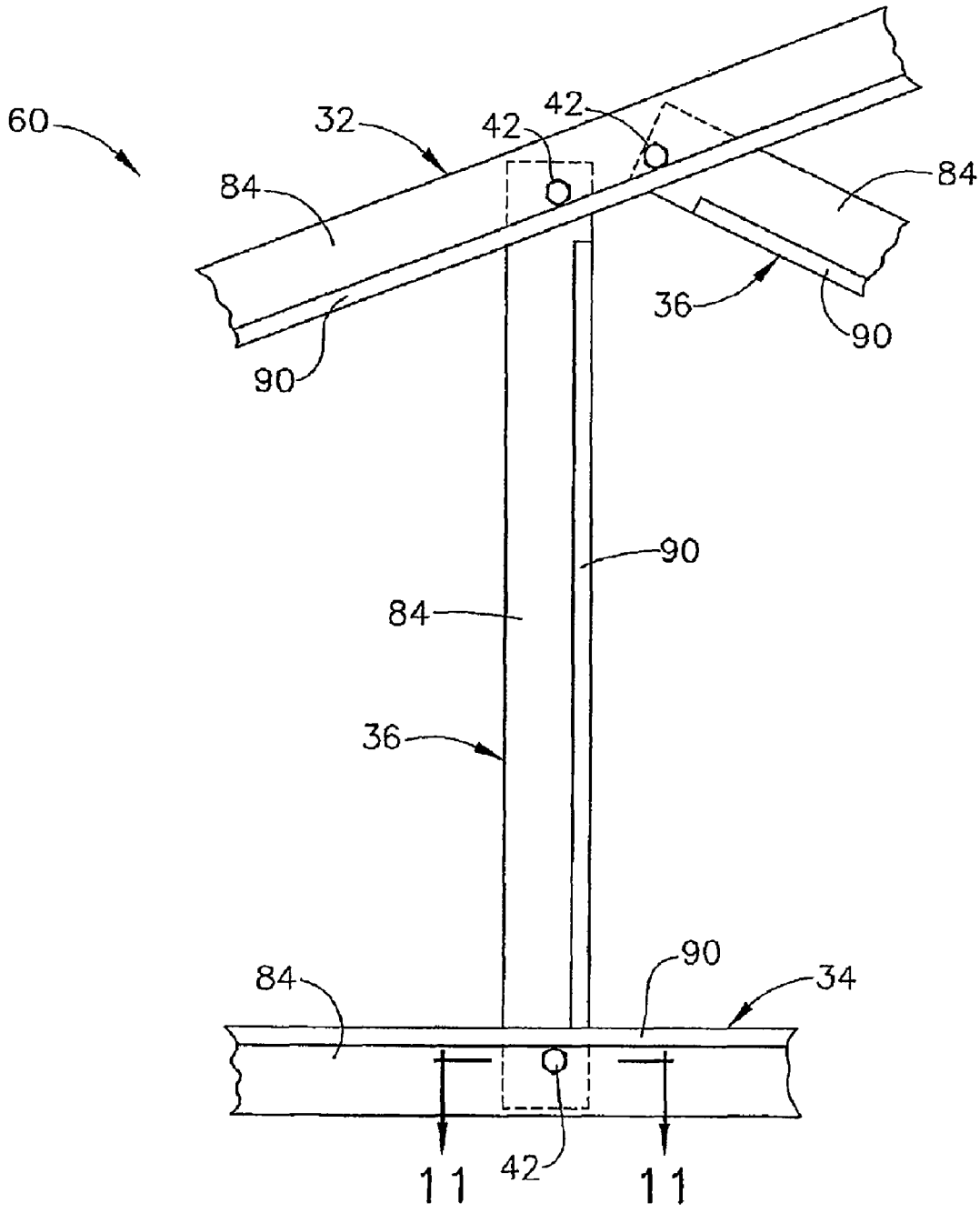
FIG. 9 is a front elevation close-up view of a portion of the embodiment of the truss assembly shown in FIG. 3 showing a joint formed at the connection of the ends of two web members to a top chord member and the end of one of the web members to a bottom chord member.
Figure 10:
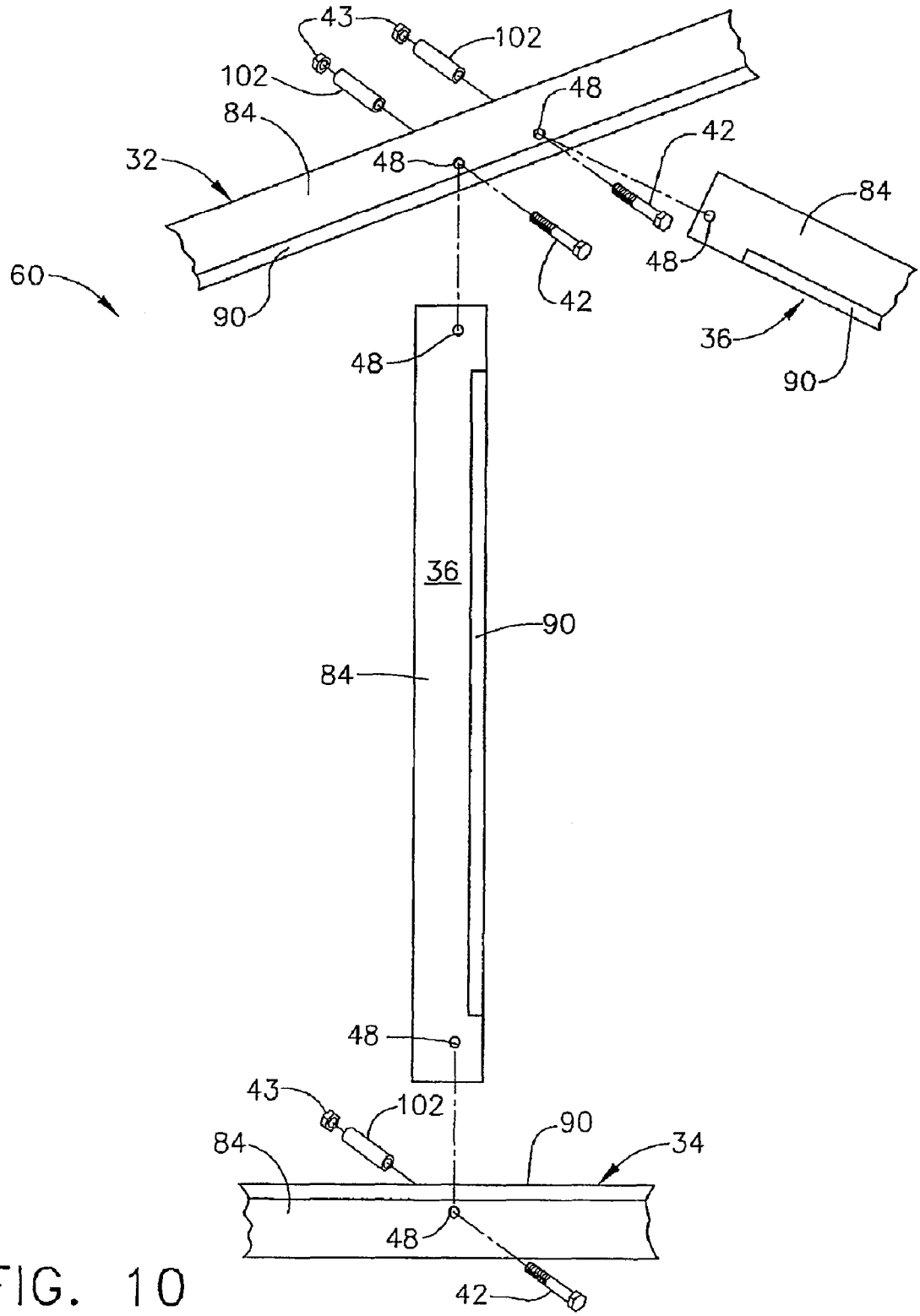
FIG. 10 is an exploded view of the portion of the truss assembly shown in FIG. 9.

FIGS. 9 and 10 show a portion of the truss assembly 60 shown in FIGS. 3 and 7. As seen in the FIGs., a joint is formed at the connection of the ends of the two web members 36 to the top chord member 32 and the opposite end of the vertical web member 36 to the bottom chord member 34. The ends of the web members 36 have a portion of the stiffening flanges 88 and lips 90 removed which allow the ends of the web members 36 to fit within the open channels 86 in the top chord member 32 and bottom chord member 34. The side webs 84 of the top chord member 32 and the bottom chord member 34 may be deformed slightly outwardly to fit over the ends of the web members 36.

Each of the top chord member 32 and the bottom chord member 34 and the web members 36 define holes 48 for receiving fasteners 42, such as bolts as shown in FIG. 10. The pattern of holes 48 near the ends of the web members 36 is juxtaposed with the pattern of holes 48 of the connecting top chord member 32 and the bottom chord member 34. The bolts 42 are received through the juxtaposed holes 48 so as to fixedly connect the truss members with associated nuts 43. It is understood that we do not intend to limit the application of the present invention to a roof truss assembly having a single juxtaposed bolt hole 48 at each joint. The number and the position of the bolt holes 48 will vary as necessary depending upon the size of the truss members 32, 34, 36 in order to provide the required structural strength. A nylon patch, which is not visible in the FIGs., may be provided at the end of the bolts 42, which resists against loosening of the nuts 43 from the bolts 42 due to vibration, cyclic loading or during transportation.

Figure 11:
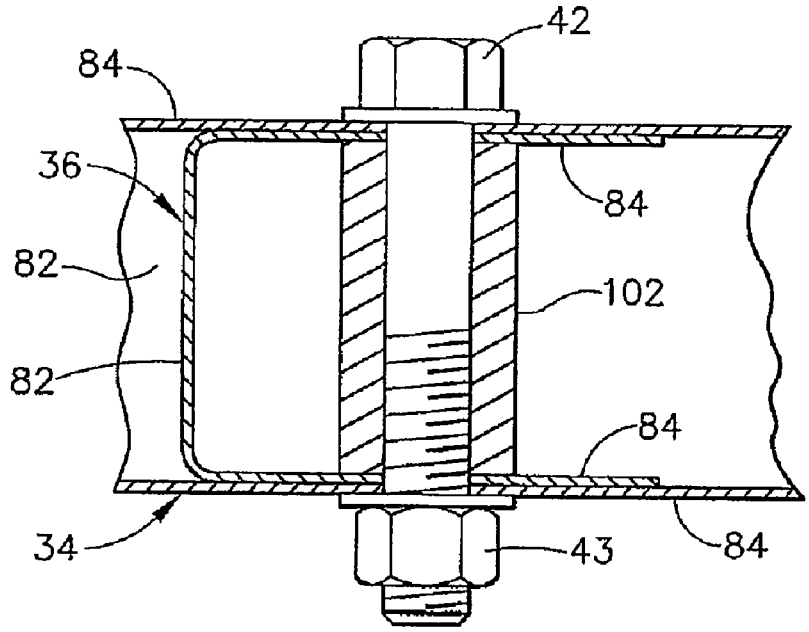
FIG. 11 is a cross-section view taken along line 11-11 of FIG. 9 showing the joint formed at the connection of the end of the vertical web member to the bottom chord member.

The connection between the top and bottom chord members 32, 34 and the web members 36 may also include a stiffener 102. As best shown in FIG. 11, the stiffener 102 is a rigid element having a bore which slips over the bolt 42 between the side webs 84 of the web member 36. The length of the stiffener 102 is substantially the same as the distance between the side webs 84 of the web member 36 when inserted into the top chord member 32 or bottom chord member 34. The stiffener 102 supports the web member 36 and prevents the web member 36 from moving during load thereby strengthening the connection point between the web member 36 and the top or bottom chord members 32, 34. The stiffener 102 may be formed from any rigid material, including plastic such as nylon, metal, and the like.

Figure 12:
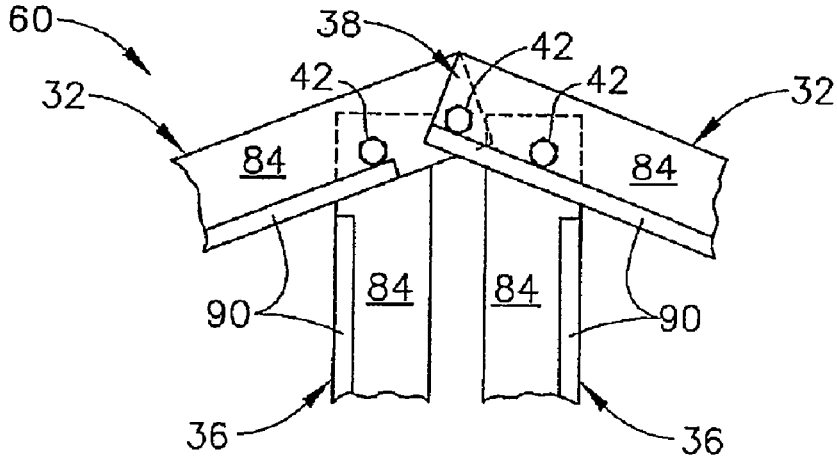
FIG. 12 is a front elevation view of an apex joint at the peak of the embodiment of the truss assembly shown in FIG. 3.
Figure 13:
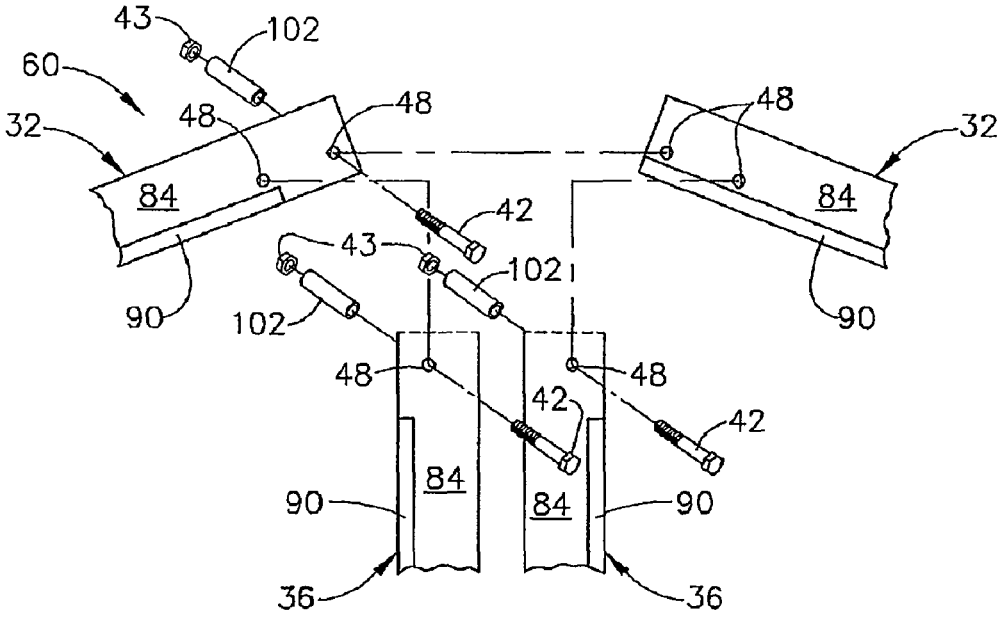
FIG. 13 is an exploded view of the apex joint shown in FIG. 13.

FIGS. 12 and 13 show the apex joint 38 formed at the peak of the third embodiment of the truss assembly 60 shown in FIGS. 3 and 7. The end of the left top chord member 32 has a portion of the stiffening flanges 88 and lips 90 removed which allows the end of the left top chord member 32 to fit within the open channel 86 of the right top chord member 32 so that the ends of the top chord members 32 overlap. It is understood that the length of the portion cut away from the stiffening flanges 88 and lips 90 depends upon the angle at which the top chord members 32 are joined. Bolt fasteners 42 secure the top chord members 32 to one another and to the upper ends of the web members 36, which have a portion of the stiffening flanges 88 and lips 90 removed, as described above.

Figure 14:
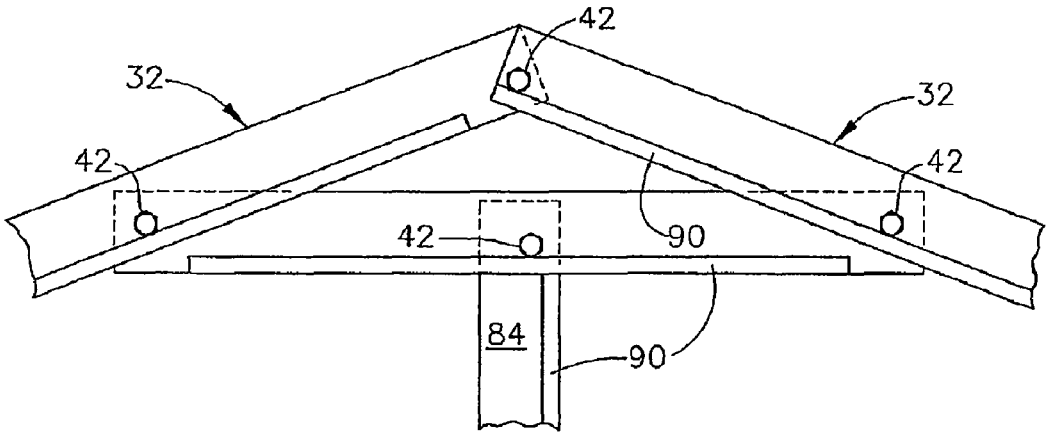
FIG. 14 is a front elevation view of another embodiment of an apex joint at the peak of a roof truss assembly.

Another embodiment of an apex joint 38 according to the present invention is shown in FIG. 14. In this embodiment, a horizontal web member 52 is provided between the top chord members 32 and a vertical web member 36. The ends of the horizontal web member 52 are received within the open channels 86 of the top chord members 32 and secured with bolt fasteners 42. The upper end of the vertical web member 36 is similarly secured to the horizontal web member 52 at substantially the mid-point of horizontal web member 52.

Figure 15:
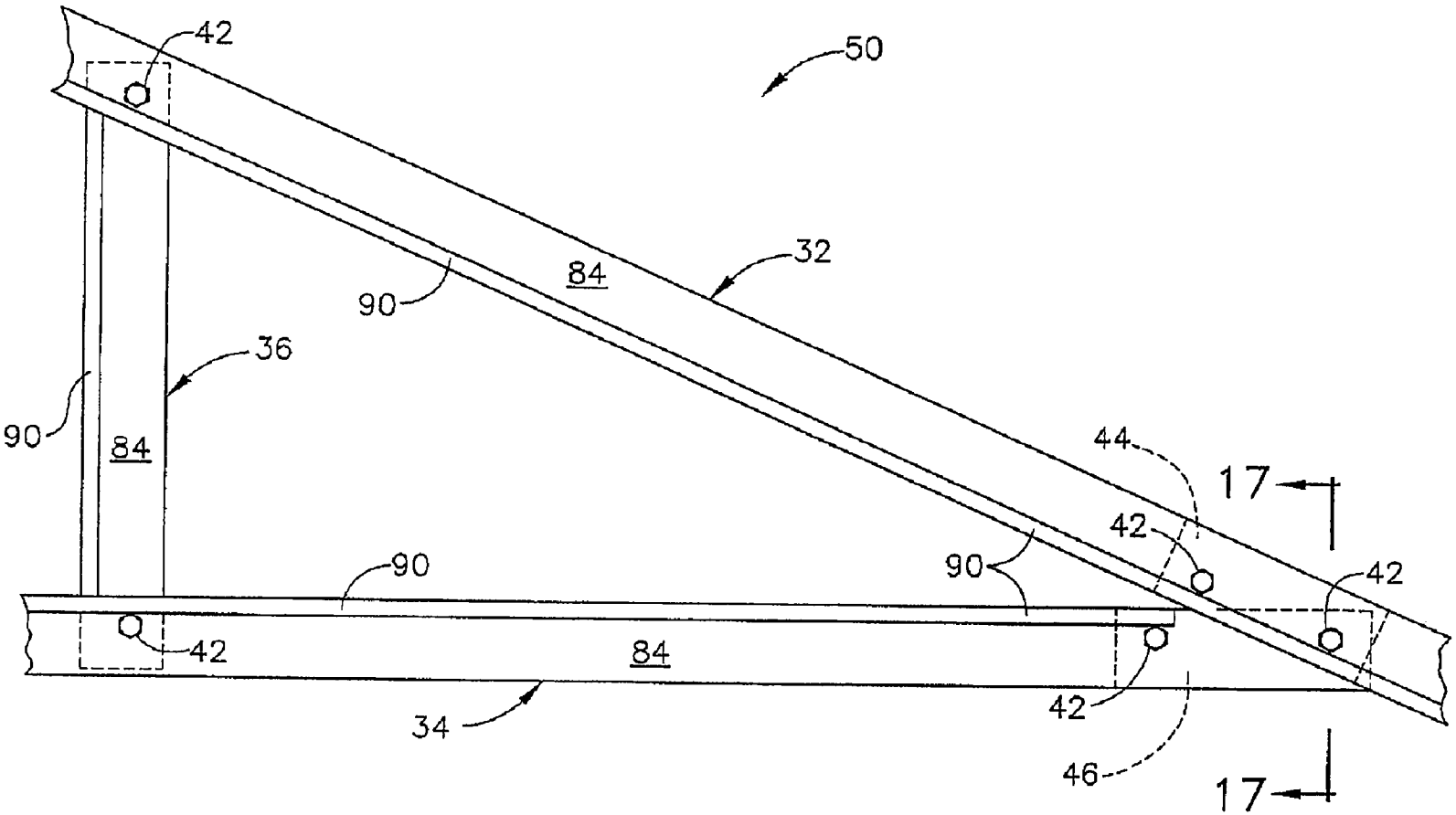
FIG. 15 is a close-up elevational view of a load bearing joint formed where the bottom chord and the top chord are joined at the lower right end of the embodiment of the truss assembly shown in FIG. 2.
Figure 16:
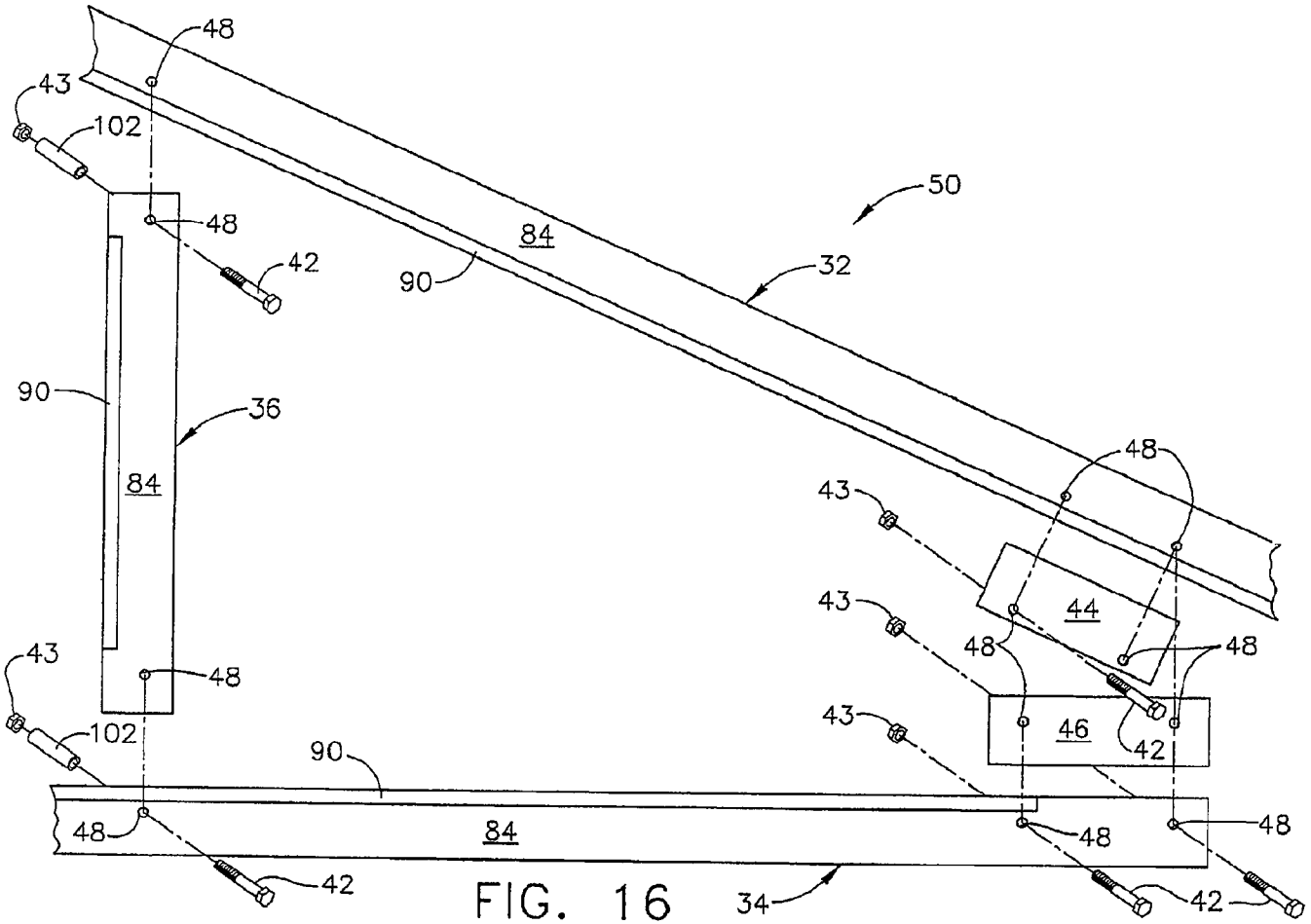
FIG. 16 is an exploded of the load bearing joint shown in FIG. 15.
Figure 17:
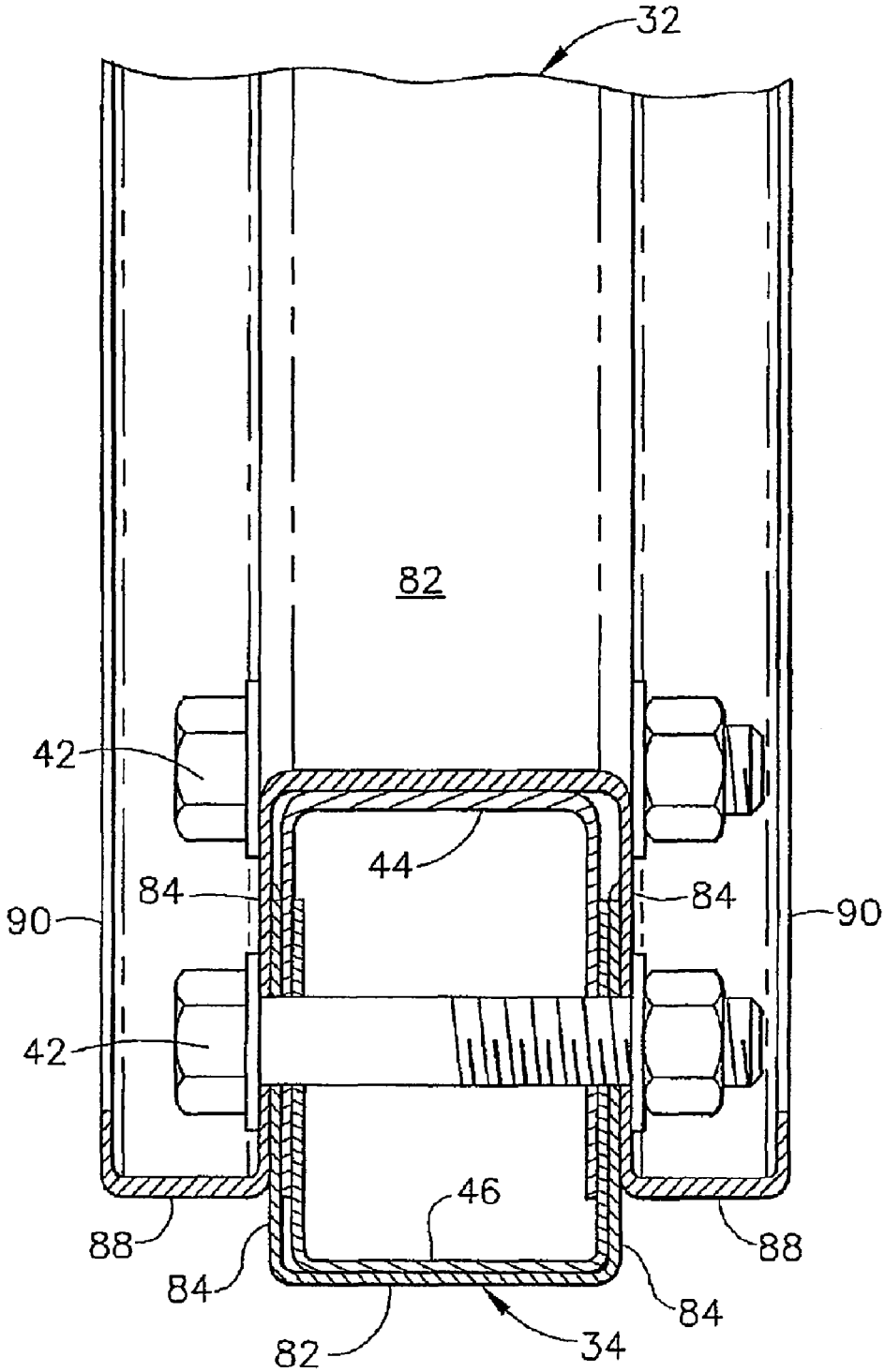
FIG. 17 is a cross-section view taken along line 17-17 of FIG. 15 showing the joint formed at the connection of the top chord member and bottom chord member.

As shown in FIGS. 15-17, a load bearing joint is provided at the lower ends of the top chord member 32 and the ends of the bottom chord member 34. Specifically, a portion of the stiffening flanges 88 and lips 90 at the end of the bottom cord member 34 is removed and the end of the bottom chord member 34 is fit into the open channel 86 adjacent the end of the top chord member 32. As best seen in FIGS. 16 and 17, the chord-to-chord connection also includes a top heel stiffener 44 and a bottom heel stiffener 46. The heel stiffeners 44, 46 are generally U-shaped in cross-section and are sized to be inserted within the channels 86 of the top and bottom chord members 32, 34 adjacent their ends. The heel stiffeners 44, 46 function as a load transfer element, facilitating the transfer of load forces between the chords 32, 34 and into the support wall (not shown) at the bearing point of the truss assembly. In addition, the bottom heel stiffener 46 strengthens the bottom chord member 34 at the bearing point. The ends of the top chord member 32 and the bottom chord member 34 and the heel-stiffeners 44, 46 are fastened together with one or more bolt fasteners 42. Alternatively, as shown in FIG. 1, a heel element 40 is fastened between the free ends of the top chord members 32 and each end of the bottom chord member 34 in the same manner as a vertical web member 36 as shown in the FIGs. and described above.

When assembled, the truss members of the truss assembly are all in essentially the same plane. It is understood that the term "planar" is not limited to having the truss members all lying within the same plane, but includes structures wherein the truss members do not lie within the same plane so long as the general extent of the truss assemblies is substantially two-dimensional.

Figure 18:
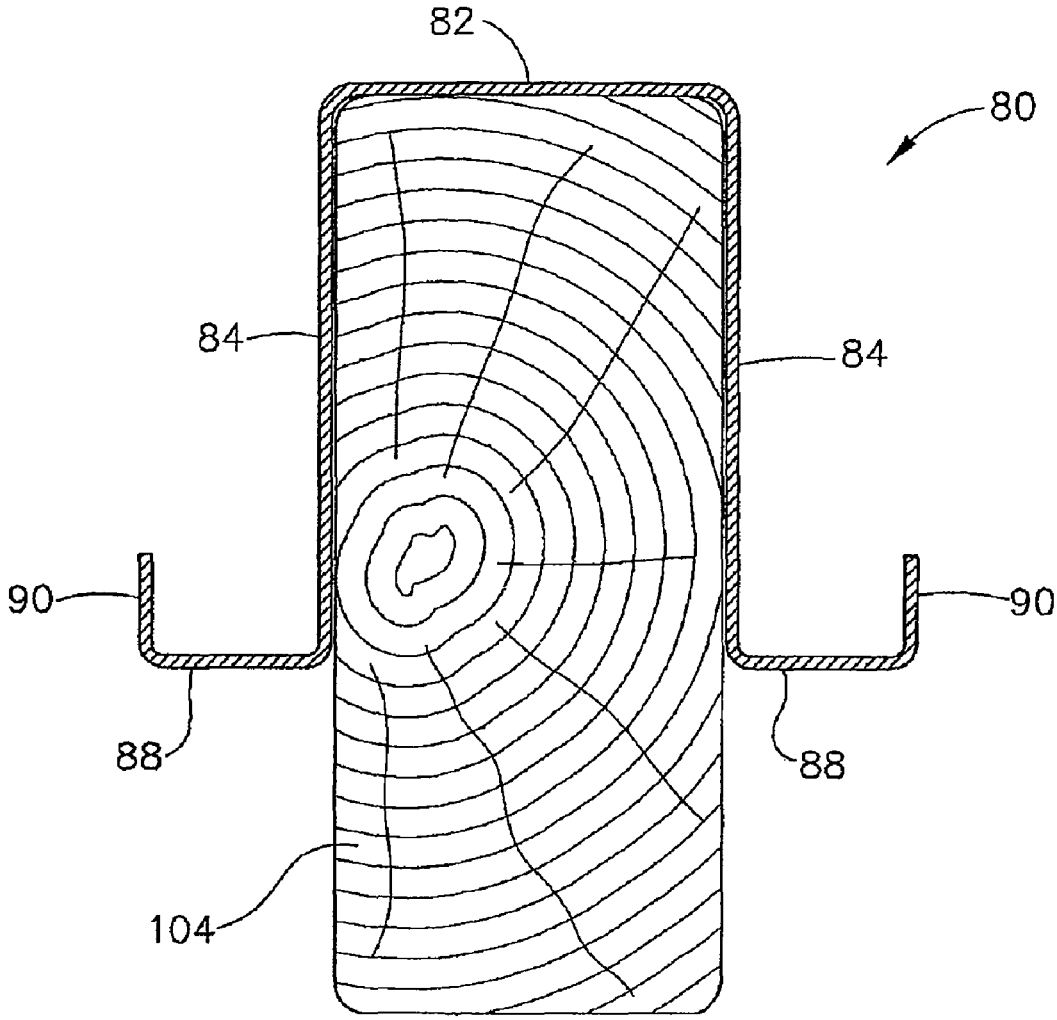
FIG. 18 is a profile section of a truss member as shown in FIG. 5 with a section of wood in the truss member.
Figure 19:
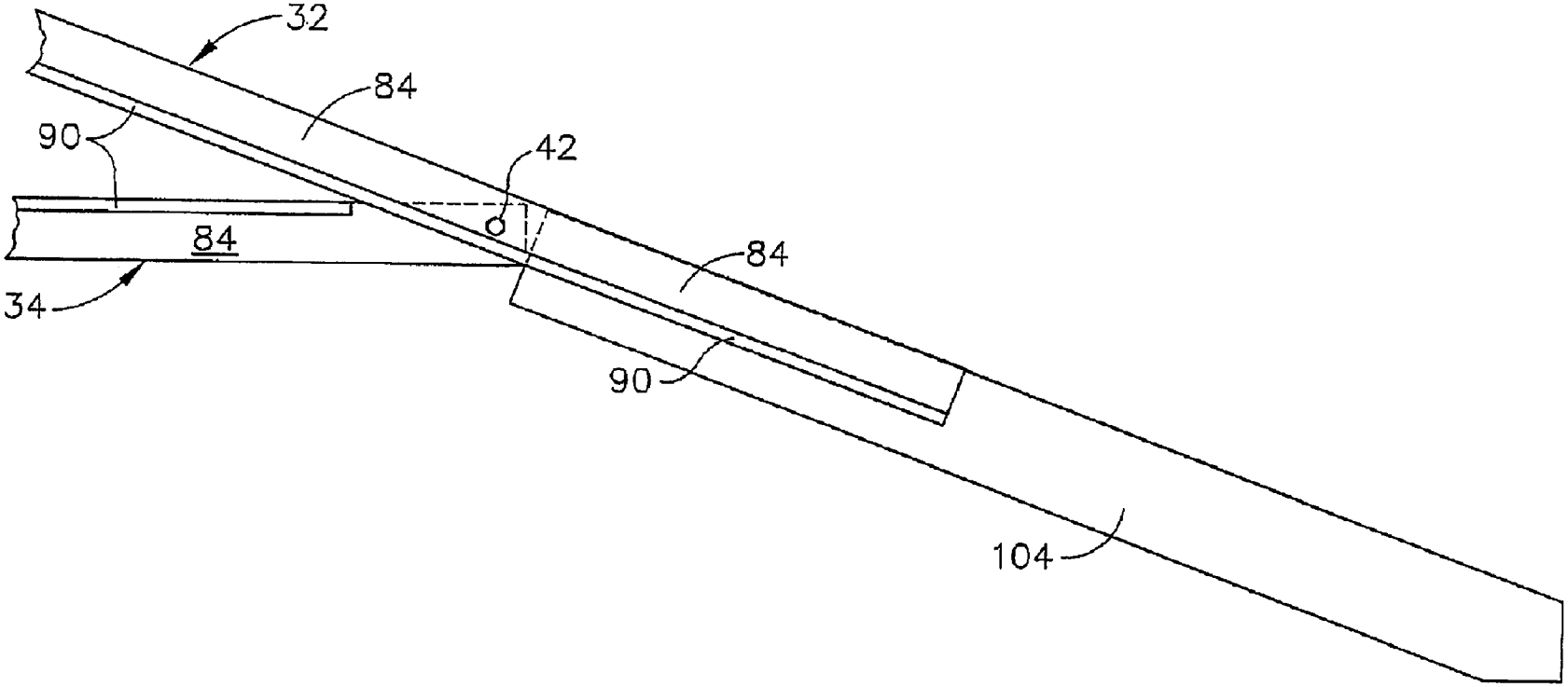
FIG. 19 is a front elevation view of one end of the truss assembly shown in FIG. 3 with a wood rafter tail in the end of the top chord.

Also in keeping with the present invention, the open longitudinal channel 86 defined by the flange portion 82 and the side webs 84 of the truss member 80, 100 may be sized to receive a wooden insert 104, as shown in FIG. 18. Preferably, the dimensions of the longitudinal channel 86 are compatible with dimensional lumber, for example, the width of the flange portion 82 being 1½" for receiving 2×2's, 2×4's, etc., depending on the depth of the channel 86. The wooden insert 104 may be fixed in position by fasteners (not shown) which extend through the flange portion 82 or the side webs 84 of the truss member 80, 100 to engage the wooden insert 104 for securing the wooden insert 104 in the truss member 80, 100. Alternatively, the inner surfaces of the side webs 84 may be provided with serrations to inhibit movement of the wooden insert 104. Portions of the side webs 84 could also be punched inwardly when the wooden insert 104 is within the channel 86 to form tangs (not shown) which bite into the surface of the wooden insert 104. The wooden insert 104 may be used as a structural component providing additional strength to a truss member 80, 100 which would eliminate the need for bracing. The wooden insert 104 also allows for a repair alternative in the field if the truss member 80, 100 is damaged. As shown in FIG. 19, the wooden insert 104 may be inserted in the channel 86 at the lower end of the top chord member 32 to form a rafter tail to accommodate wood extensions for fascia.

Figure 20:
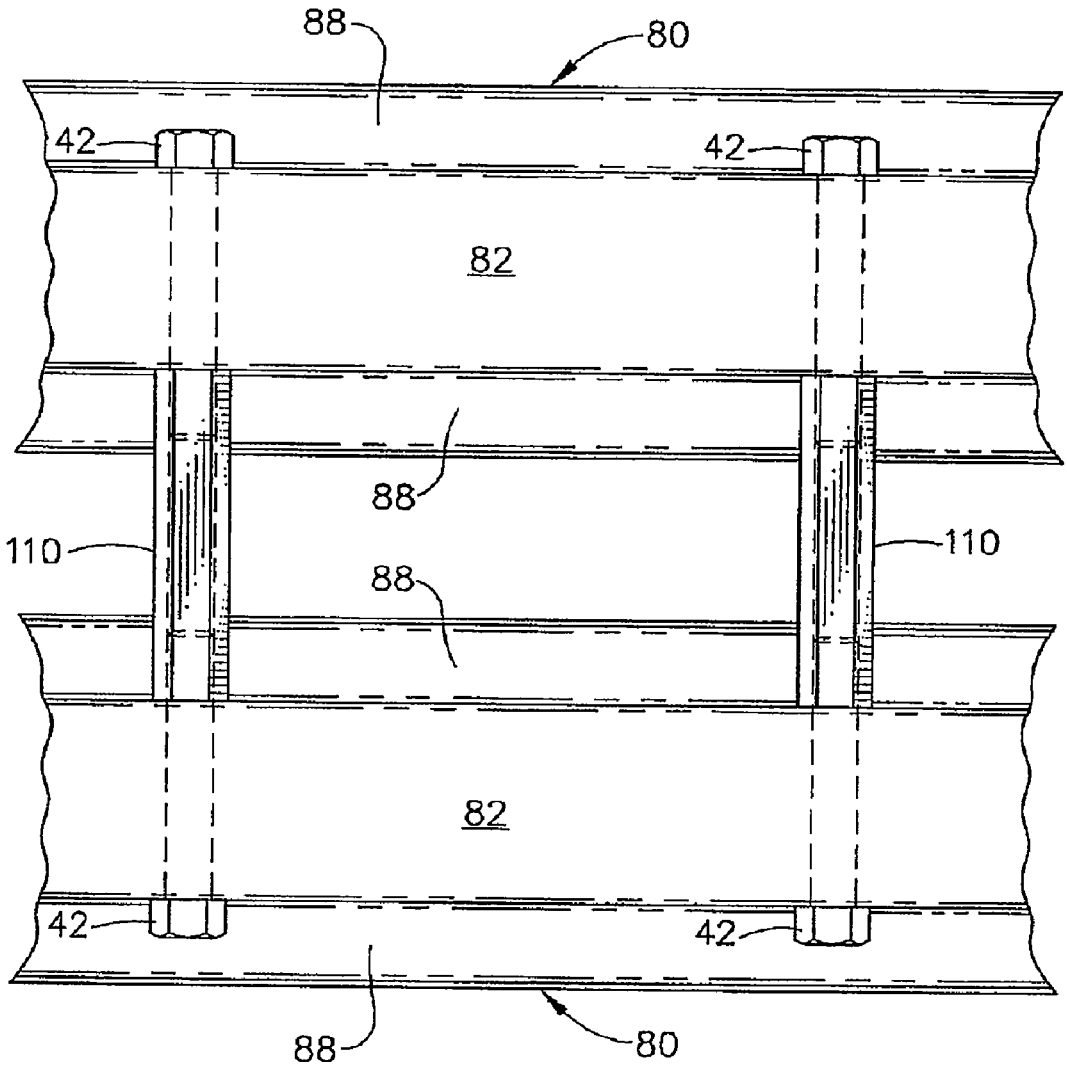
FIG. 20 is a top plan view of a portion of a multi-truss assembly.
Figure 21:
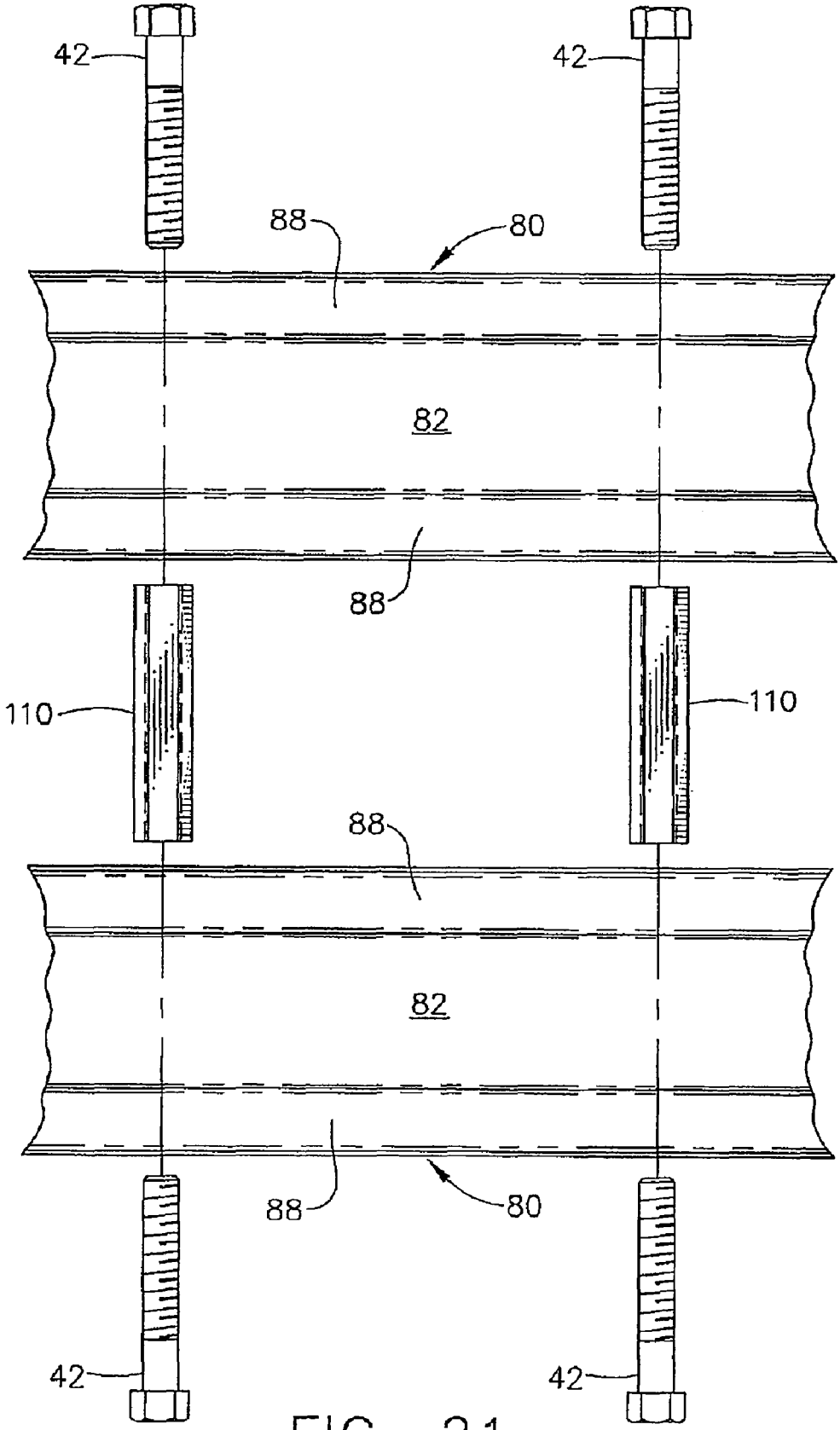
FIG. 21 is an exploded view of the multi-truss assembly shown in FIG. 20.

Two truss assemblies may be connected together where added strength is needed. FIGS. 20 and 21 show this connection, which is accomplished using two bolts 42 and a threaded ply nut 110 positioned between the truss members for securing the truss members together at a plurality of locations. Preferably, the truss assemblies are connected together at each node point to ensure even distribution of load throughout the truss assemblies. The space between the truss members provided by eliminates any chance for squeaking during cyclic loading.

In a method for producing a truss assembly according to the present invention, truss members can be produced from flat coils of sheet metal using an automated roll forming machine. A suitable roll forming machine may include a processor, such as a computer, programmed and controlled to produce the structural truss members for the truss assembly according to a predetermined plan. The roll forming machine is provided with the plan for the truss assembly to be produced, including the positioning of each of the truss members. The various truss members are generated to an appropriate length and having the necessary features for joining the truss members, including holes for fasteners and flanges and lips removed from the side webs at the ends to accommodate intersecting truss members. The notches and holes are positioned to align with holes on mating structural truss members so the parts of the truss assembly may be easily and quickly assembled. There is no need for boring or punching holes during the assembly of the truss assembly. Additionally, service holes may be provided in the structural truss members to accommodate electrical wiring or other utilities. Using the method according to the present invention, a finished truss assembly is built from a single strip of flat coil metal stock, which significantly reduces the need to maintain inventory because there is no need for pre-manufactured stock length material.

The computer-controlled roll forming machine will produce the truss members precisely according to the specifications determined by the processor. Thus, the design and production process for the truss assemblies for buildings is substantially automated. Moreover, since all of the truss members are formed with a common cross-section, production is simplified. The truss members are produced in a convenient order, enabling each truss member after the first to be immediately assembled with the previous truss members as the truss member is produced and without any subsequent forming operations. Furthermore, because the holes and intersecting ends of truss members are automatically formed by the roll forming machine, the truss members can be simply fitted and secured together without the need for special framing jigs to hold the truss members in position while holes are drilled, which eliminates the need for setup tables and the time required to layout the trusses prior to fabrication. The truss assemblies may be assembled with the use of simple free standing rests which are moveable, as required, to a convenient location to hold the truss members at a convenient height.

Software for the design of the truss assemblies and operation of the roll forming machine as described above, is available. For example, a suitable design and fabrication methodology has been described in U.S. Pat. No. 6,253,521, which issued Jul. 3, 2001, and is entitled "Steel-Framed Building Construction"; U.S. Pat. No. 6,272,447, which issued Aug. 7, 2001, and is entitled "Fabrication And Design Of Structural Members"; and U.S. Pat. No. 6,757,643, which issued Jun. 29, 2004, and is entitled "Fabrication And Design Of Structural Members", the contents of all of which are incorporated herein by reference in their entirety. The software provides a "real time" drawing during production, including the location within the final assembly of the each truss member being produced, to simplify the fabrication process.

Additionally, the truss members may be produced on a building site using a portable roll forming machine, as is known in the art. On-site production from metal coils eliminates the need to bundle and carry lengths of metal section and to sort the structural truss members. On-site production also avoids any confusion as to the precise location of each structural truss member.

While the invention is illustrated and described herein in terms of a domestic dwelling, it is understood that the invention is not limited to the construction of domestic buildings and will have application in commercial and industrial construction.

Although the present invention has been shown and described in considerable detail with respect to a particular exemplary embodiments thereof, it should be understood by those skilled in the art that we do not intend to limit the invention to the embodiment since various modifications, omissions and additions may be made to the disclosed embodiments without materially departing from the novel teachings and advantages of the invention, particularly in light of the foregoing teachings. For example, the truss profile and the number and position of the truss members may be any of a number of such truss arrangements known in the art. Accordingly, we intend to cover all such modifications, omissions, additions and equivalents as may be included within the spirit and scope of the invention as defined by the following claims. In the claims, means-plus function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method of forming a roof truss assembly, the method comprising the steps of:

providing a coil of substantially flat sheet metal;

cutting a plurality of lengths of the sheet metal;

forming structural members from each of the lengths of metal, wherein the structural members include a first top chord, a second top chord, a bottom chord, and a web member, each structural member comprising a planar base terminating in longitudinal edges, planar legs extending from the longitudinal edges of the base and terminating in longitudinal edges, the legs extending the length of the base such that the base and the legs define an open longitudinal channel, and a flange integral with the longitudinal edges of each leg, each flange having a planar first portion extending outwardly from the legs and terminating in longitudinal edges, and a planar second portion extending from the longitudinal edges of the first portion of the flanges and terminating in longitudinal edges, the flanges selectively extending the length of the legs;

removing a portion of the flanges from an end of the first top chord;

inserting the end of the first top chord into the channel defined by the legs and the base of adjacent one end of the second top chord so that the outer surface of the legs of the first top chord are adjacent the inner surface of the legs of the second top chord for forming an apex of a top chord assembly;

removing a portion of the flanges at both ends of the bottom chord;

inserting each end of the bottom chord into the top chord assembly into the channels defined by the legs and the base adjacent the free ends of the first and second top chords so that the outer surface of the legs of the ends of the bottom chord are adjacent the inner surface of the legs of the first and second top chords;

removing a portion of the flanges at both ends of the web member, inserting the one end of the web member into the channel defined by the legs and the base of the bottom chord so that the outer surface of the legs of the web member are adjacent the inner surface of the legs of the bottom chord and the other end of the web member into the channel defined by the legs and the base of one of the first or second top chord so that the outer surface of the legs of the web member are adjacent the inner surface of the legs of the one of the first or second top chord.

2. A method of forming a roof truss assembly as recited in claim 1, further comprising the step of securing the joined structural members together to form rigid connecting joints.

3. A method of forming a roof truss assembly as recited in claim 1, wherein the open channels of the top chords and the bottom chord face one another.

4. A method of forming a roof truss assembly as recited in claim 1, further comprising the steps of providing a channel member having a planar body terminating in longitudinal edges and legs extending from the longitudinal edges of the body, and inserting the channel member into the channels at each of the joined ends of the bottom chord and the first and second top chords with the body of each channel member overlying the base of the respective structural member and the outer surfaces of the legs of the channel members adjacent the inner surface of the legs of the structural members.

5. A method of forming a roof truss assembly as recited in claim 4, further comprising the step of securing the joined structural members and channel members together to form rigid connecting joints.

* * * * *